US007086542B2

(12) United States Patent
Tomonari et al.

(10) Patent No.: US 7,086,542 B2
(45) Date of Patent: Aug. 8, 2006

(54) COMMODITY DISPLAY DEVICE

(75) Inventors: Nobuyuki Tomonari, Tokyo (JP); Kenji Kosugi, Tokyo (JP)

(73) Assignee: Tamatoshi Co., Ltd., Tokyo (JP)

( * ) Notice: Subject to any disclaimer, the term of this patent is extended or adjusted under 35 U.S.C. 154(b) by 32 days.

(21) Appl. No.: 10/758,158

(22) Filed: Jan. 15, 2004

(65) Prior Publication Data

US 2004/0149669 A1 Aug. 5, 2004

(30) Foreign Application Priority Data

Jan. 31, 2003 (JP) ..... P2003-025227

(51) Int. Cl.
*A47F 5/08* (2006.01)

(52) U.S. Cl. ..... 211/94.01

(58) Field of Classification Search ..... 211/94.01, 211/94.02, 162; 248/224.51, 224.61
See application file for complete search history.

(56) References Cited

U.S. PATENT DOCUMENTS 4,308,961 A 1/1982 Kunce
4,429,850 A * 2/1984 Weber et al. ..... 248/250
4,817,900 A * 4/1989 Whittington et al. .. 248/223.41
5,125,518 A * 6/1992 Ward ..... 211/87.01
5,484,067 A * 1/1996 Sothman ..... 211/87.01
6,349,507 B1 * 2/2002 Muellerleile ..... 52/36.5
6,547,086 B1 * 4/2003 Harvey ..... 211/87.01

FOREIGN PATENT DOCUMENTS

| | | |
|---|---|---|
| DE | 200 12 147 | 11/2001 |
| EP | 0 568 158 | 11/1993 |
| GB | 2 224 923 | 5/1990 |
| GB | 2 278 996 | 12/1994 |
| JP | 2-59660 | 5/1990 |
| JP | A 9-189094 | 7/1997 |
| JP | 2000-354527 | 12/2000 |

* cited by examiner

*Primary Examiner*—Sarah Purol
(74) *Attorney, Agent, or Firm*—Sturm & Fix LLP

(57) ABSTRACT

Catching grooves 2*d*, 2*e* are formed in a turning space 2*f* of a catching protrusion bar 2*b*, engagement projections 3*c*, 3*d* are formed on a standing part 3*b* of a catching member 3*a*, and the standing part 3*b* is inserted into the turning space 2*f*, so that the engagement projections 3*c*, 3*d* are respectively engaged with the catching grooves 2*d*, 2*e* by the own weight of the catching member 3*a*.

3 Claims, 8 Drawing Sheets

COMMODITY DISPLAY DEVICE

CROSSREFERENCE TO RELATED APPLICATIONS

This application is based upon and claims the benefit of priority from the prior Japanese Patent Application No. 2003-025227, filed Jan. 31, 2003, the entire contents of which are incorporated herein by reference.

BACKGROUND

1. Field of the Invention

The present invention relates to a commodity display device, which can easily provide a space for displaying commodities and the like by forming a commodity display wall surface on a wall of shops or exhibition booths to cover the wall and detachably fitting support members for hanging and placing commodities to the commodity display wall surface.

2. Description of the Related Art

Conventionally, commodities were exhibited and displayed by having shelf receiving pillars (pillars with slits) and the like attached to a wall of shops, exhibition halls and the like, and members such as shelf receiving brackets, shelf boards, hanger pipes, hooks and the like attached to the pillars to exhibit and display the commodities. A display space for the display and sale of commodities was formed by having a wall surface member or the like, to which shelf members or hanging members were detachably attached, attached to a wall surface of shops, exhibition booths and the like and the shelf members or the hanging members fitted to the wall surface member. Specifically, the wall surface member was attached in plural stages vertically to form a display wall surface, and the shelf members or the hanging members were attached to the wall surface to form the commodity display space. For example, the shelf members or the hanging members called as hooks or brackets were disposed on a vertical wall surface member as required, and the commodities were directly suspended from the hooks or the brackets, or shelf boards were placed on the brackets to display the commodities on the shelf boards.

The commodity display is required that the wall surface member itself has a decorative effect. Generally, the wall surface member itself is fixed to a wall surface of shops or the pillars erected in the exhibition booth with fittings such as screws from the surface side of the wall surface member.

However, it is general that a conventional wall surface member for the display of commodities has the shelf members or the hanging members attached from above to the wall surface member. Therefore, it is suitable because a load is naturally applied when such members are attached. But, there was a problem that the shelf members or the hanging members were easily removed by applying an upward small force because they were not locked against an upward force.

Work to horizontally fix plural catching members to the wall surface member is troublesome, and it is hard to smoothly and quickly conduct the commodity displaying work. Therefore, after the catching members are attached, each attaching/removing operation of the hooks or the brackets to those catching members is troublesome, and their attaching/removing positions become static.

When the wall surface member was fixed to the wall surface or pillars of the shops and the like with screws from the front side, the screw heads were exposed on the surface of the wall surface member, degrading a decorative effect and an interior effect of the wall surface member itself.

The present invention remedies the existing drawbacks and provides a commodity display device which can display or hang commodities with shelf members or hanging members, which are attached to a wall surface member, readily and securely attached by a single operation from below. It is also an advantage of the invention to provide a commodity display device, which can prevent screws for fixing the wall surface member from being exposed on the wall surface.

BRIEF SUMMARY OF THE INVENTION

A commodity display device according to an embodiment of the present invention comprises a wall surface member having a turning space with catching grooves formed on its inside wall by forming a catching protrusion bar on a long vertical wall surface, which is to be attached to a wall surface or the like of a shop or the like, so to protrude and overhang from the vertical wall surface and extending the catching protrusion bar downward to form a semicircular flection, and a hanging shelf member having a catching member vertically formed at a leading end of a rod shape support member for supporting commodities or the like to be displayed, a leading end of the catching member bent into an L shape to form a standing part, and engagement projections formed on the bent part and the pointed part of the standing part; wherein the standing part of the hanging shelf member is turned along the inside wall surface of the turning space of the wall surface member to engage the engagement projections of the standing part with the catching grooves, the catching member comes into close contact with the vertical wall surface, and the support member becomes substantially vertical with respect to the vertical wall surface.

The turning space of the wall surface member of the invention comprises a catching groove formed on the vertical wall surface; a catching groove formed on the inner side of the leading end of the semicircularly bent catching protrusion bar; and a hollow part in which the catching member turns.

The engagement projections of the hanging shelf member are formed by protruding on the back surface of the standing part which is bent into the L shape and slanting a pointed part formed by bending the catching member.

According to the commodity display device of the invention, the standing part of the catching member of the hanging shelf member is turned to insert from below into the turning space of the wall surface member, and two engagement projections of the standing part are turned within the turning space to be automatically guided so to be fitted into the catching grooves of the turning space. In this case, the catching member comes into close contact with the vertical wall surface, and the engagement projections are fitted into the catching grooves by the own weight of the hanging shelf member. An upward force does not disconnect the fitting of the engagement projections. Thus, the support member can be held stably.

The commodity display device of the invention has the catching grooves in the hollow part and the engagement projections mutually engaged by the turning operation of the engagement projections and a pressure welding by the own weight of the hanging shelf member.

According to the commodity display device of the invention, the attaching/removing operation of the engagement projections of the hanging member can be conducted quickly and easily by a single operation.

Besides, the commodity display device of the present invention comprises the vertical wall surface comprising plural wall surface members, which are assembled to be mutually adjacent in a vertical direction, and one of the adjacent wall surface members is screwed to cover setscrews of the other wall surface member.

According to the commodity display device of the invention, the vertical wall can be installed to have an area according to the space, height and the like of a shop, and setscrews are prevented from being exposed so to directly enhance a decorative effect and an interior effect of the entire vertical wall surface.

BRIEF DESCRIPTION OF THE DRAWINGS

The present invention will be described with reference to the drawings, which are provided for illustration only and do not limit the invention in any respect.

DETAILED DESCRIPTION OF THE INVENTION

One embodiment of the invention will be described with reference to the accompanying drawings.

Figure 1:
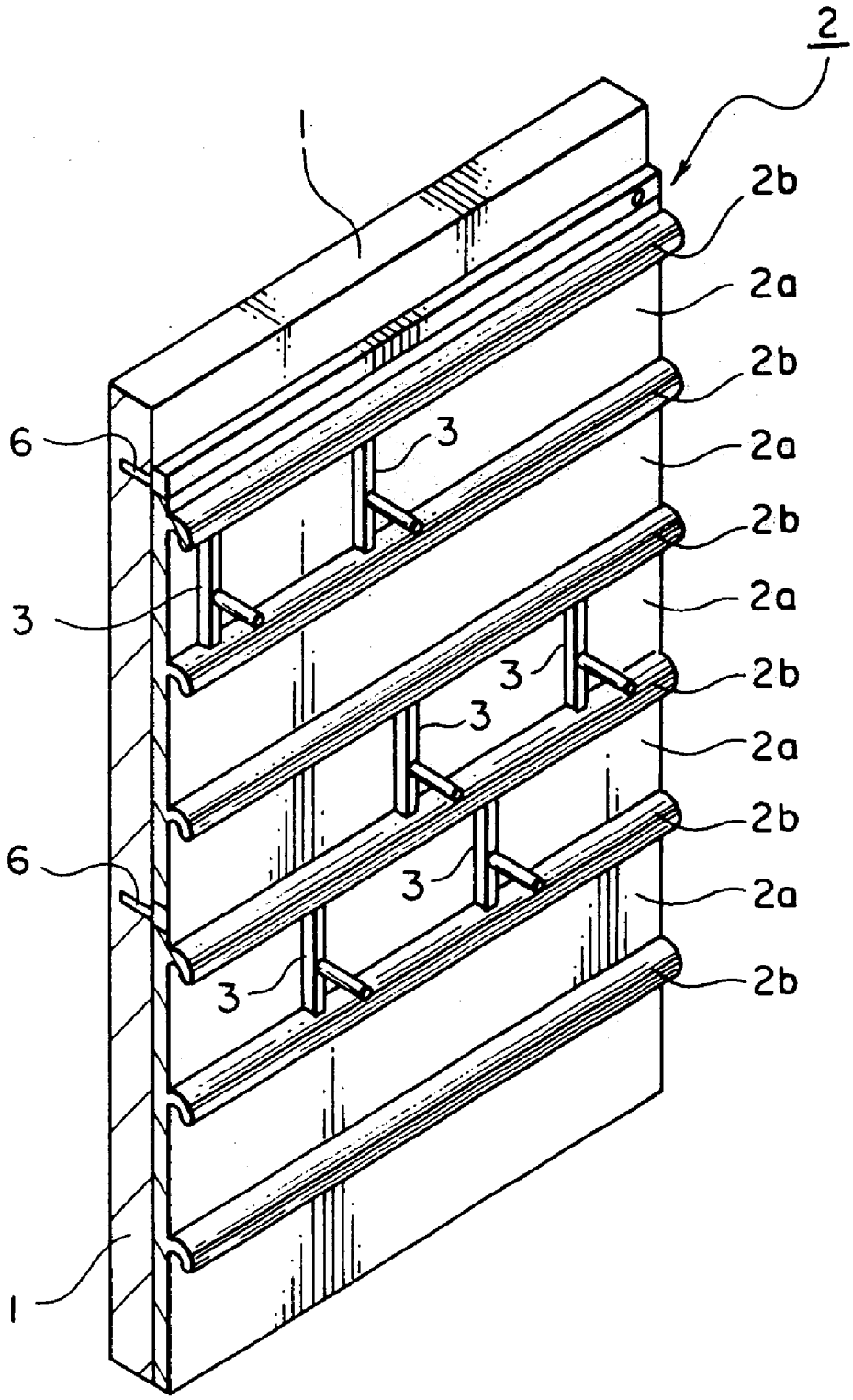
FIG. 1 is a perspective view schematically showing the commodity display device according to one embodiment of the invention.
Figure 2:
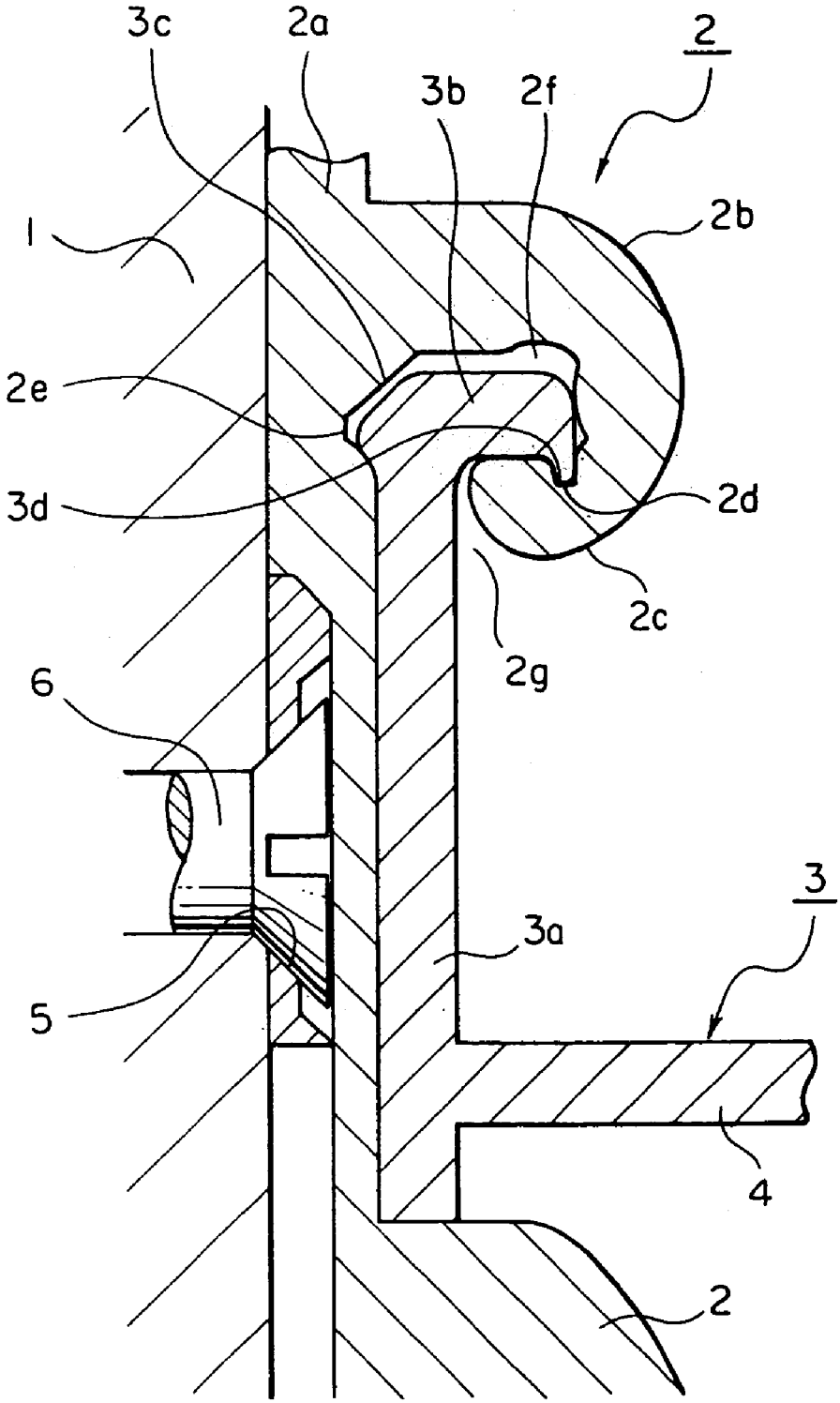
FIG. 2 is an expanded sectional view of a substantial part of the commodity display device according to an embodiment of the invention.
Figure 3:
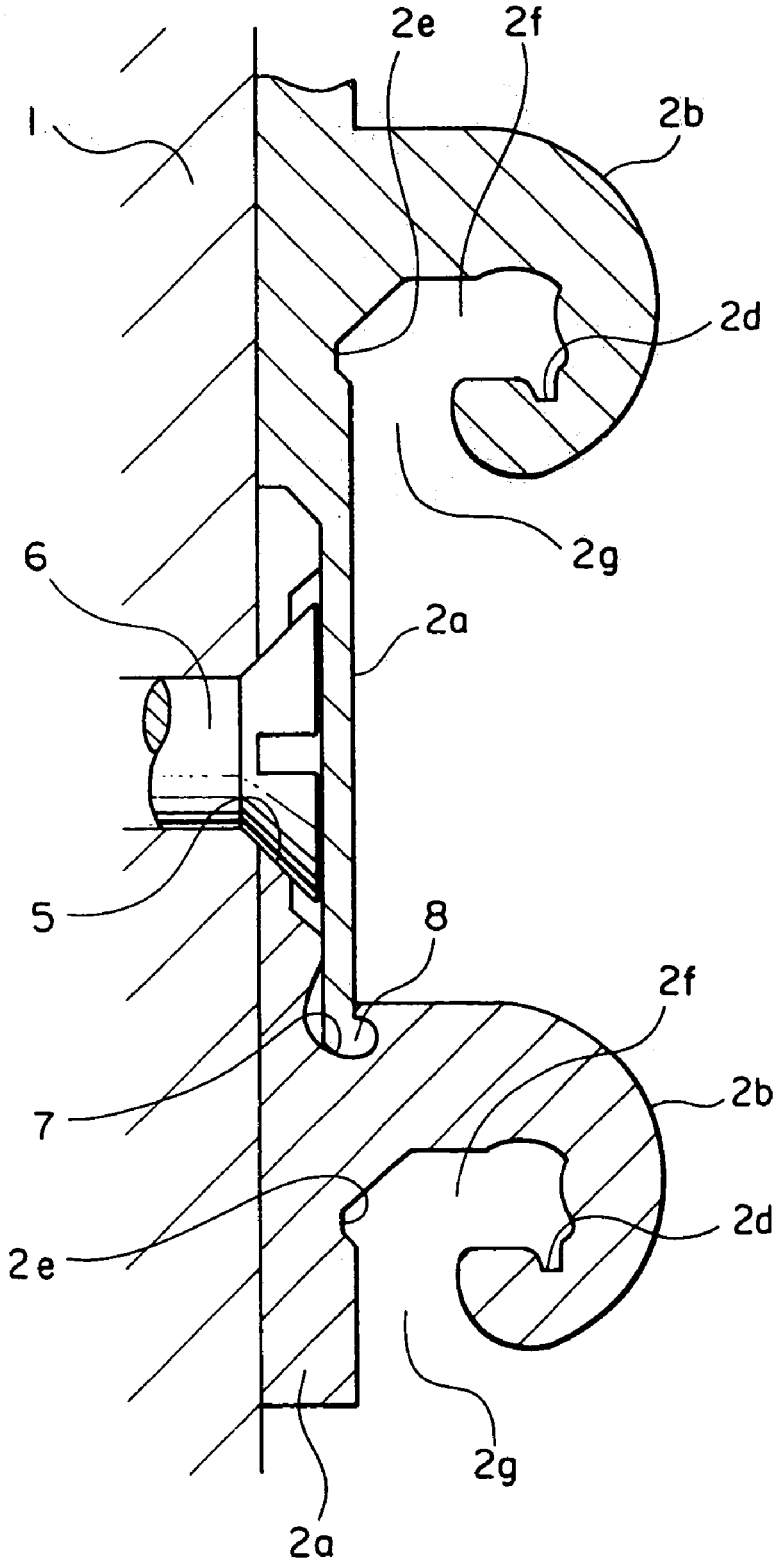
FIG. 3 is an expanded sectional view of a substantial part of the structure of wall surface members attached to a wall surface according to an embodiment of the invention.
Figure 4:
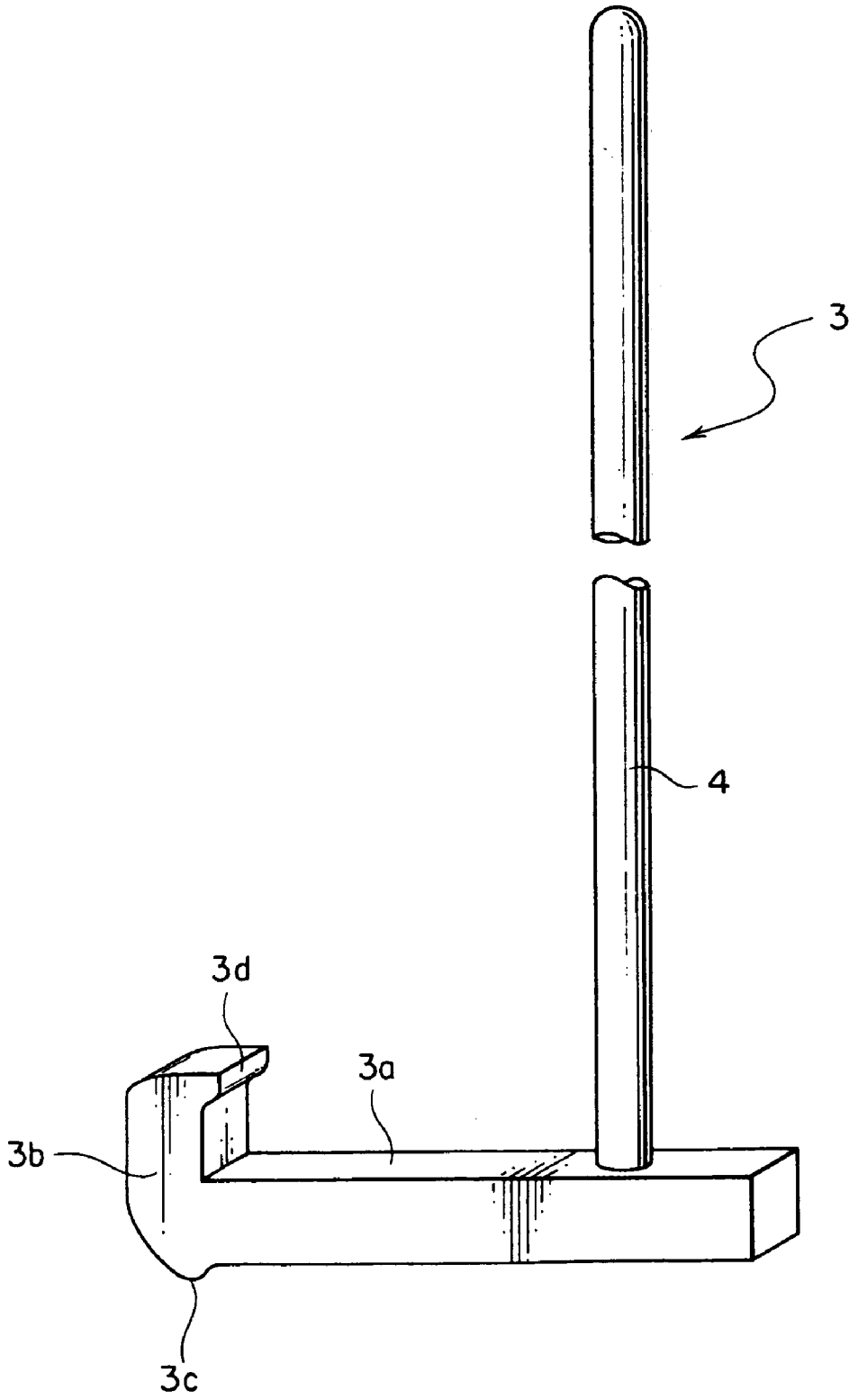
FIG. 4 is a perspective view showing an example of a hanging shelf member according to an embodiment of the invention.
Figure 5:
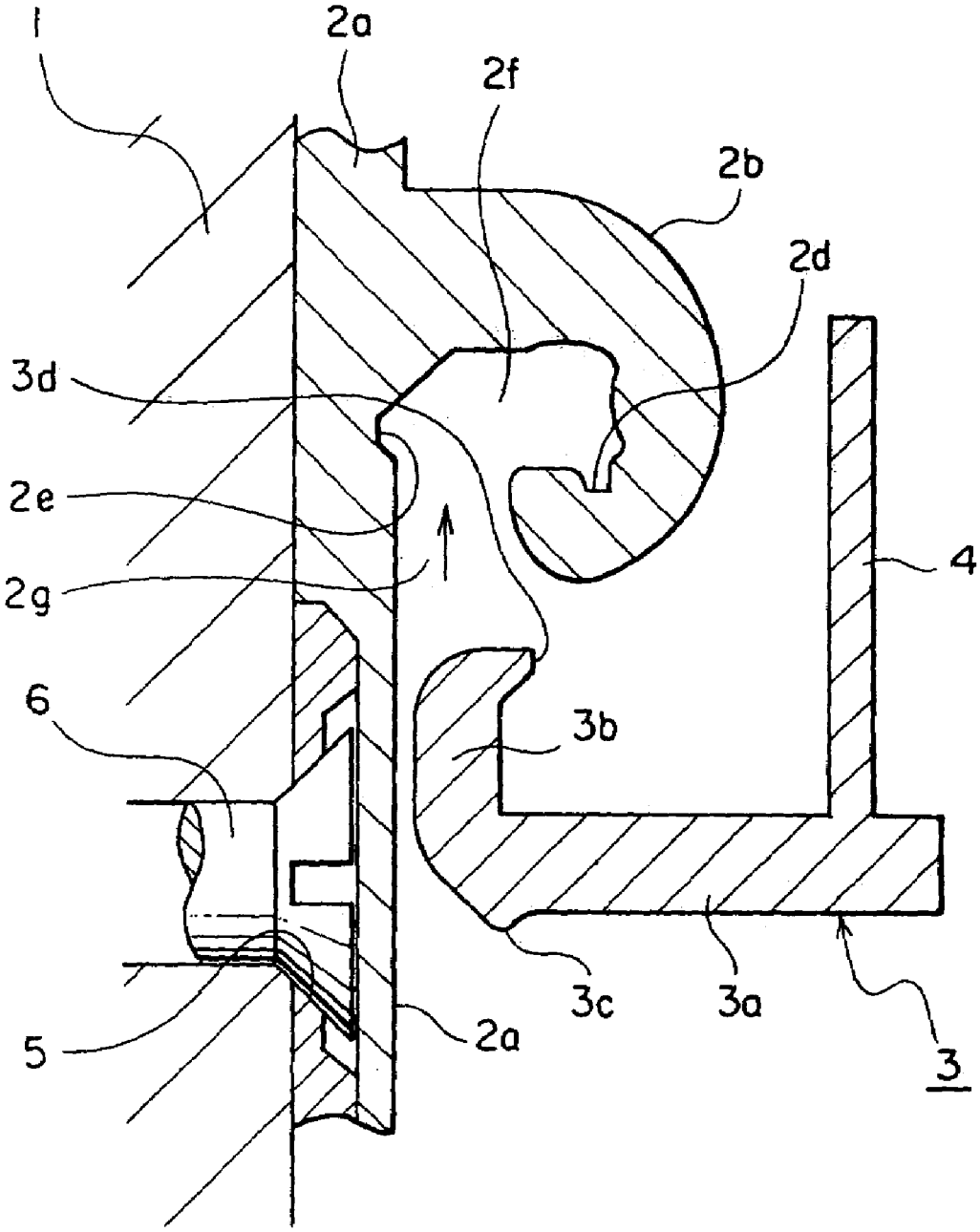
FIG. 5 is an expanded sectional view of a substantial part showing a procedure of assembling the commodity display device according to an embodiment of the invention.
Figure 6:
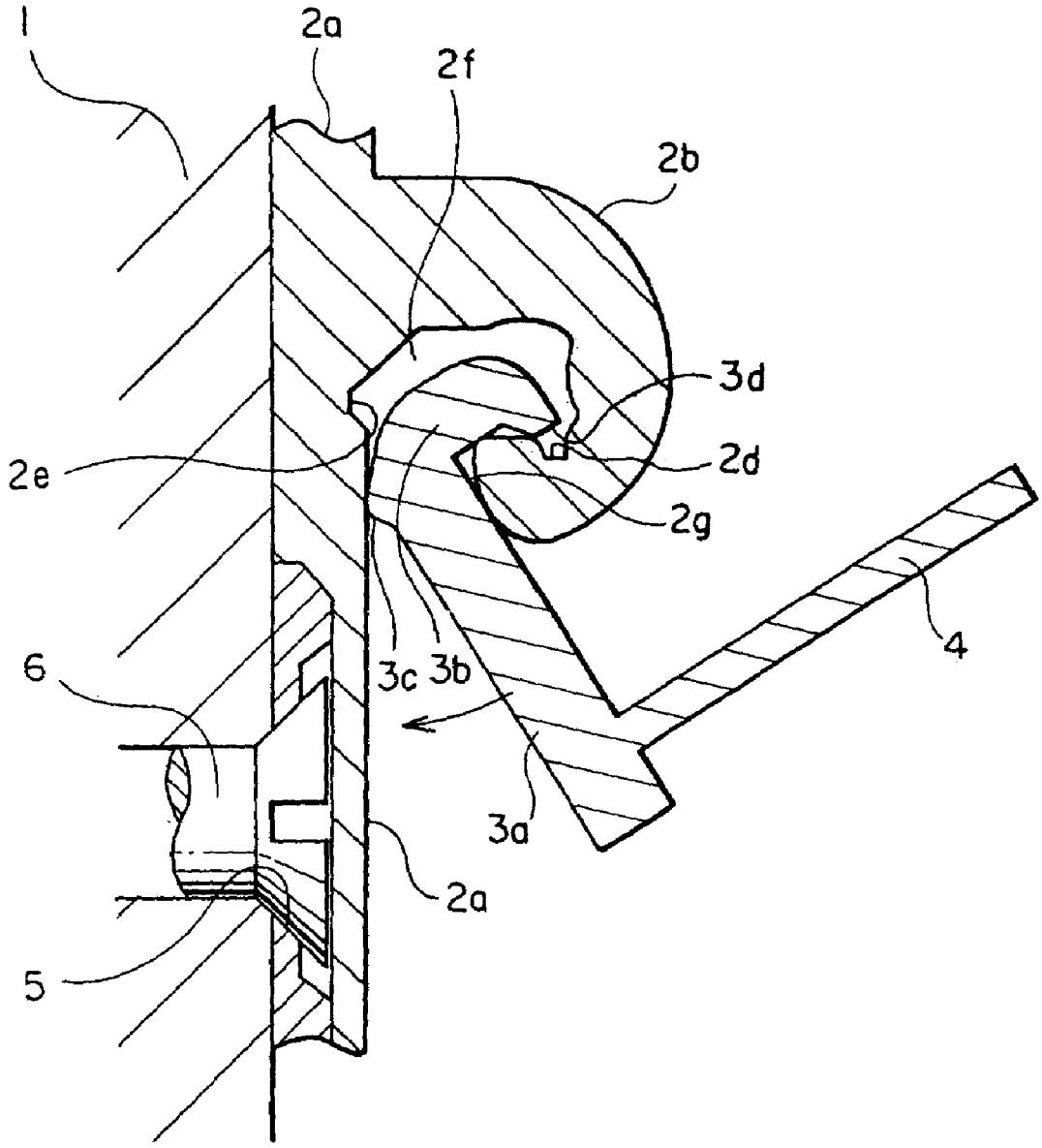
FIG. 6 is an expanded sectional view of the substantial part showing the procedure of assembling the commodity display device according to the embodiment of the invention.
Figure 7:
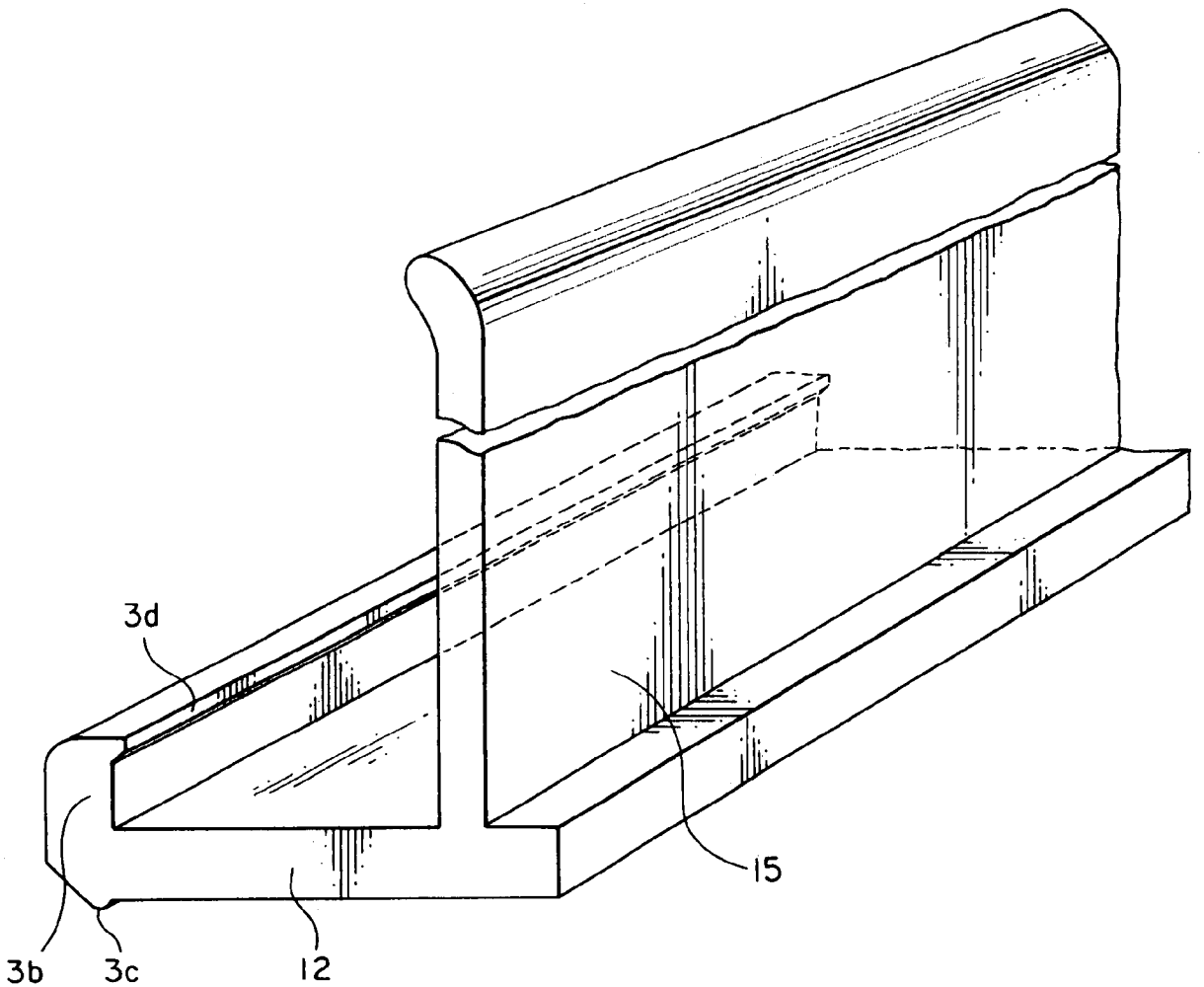
FIG. 7 is a perspective view showing another example of the hanging shelf member according to an embodiment of the invention.

FIG. 1 is a perspective view schematically showing the commodity display device according to one embodiment of the invention; FIG. 2 is an expanded sectional view of a substantial part of the commodity display device according to an embodiment of the invention; FIG. 3 is an expanded sectional view of a substantial part of the structure of wall surface members attached to a wall surface according to an embodiment of the invention; FIG. 4 is a perspective view showing an example of a hanging shelf member according to an embodiment of the invention; FIG. 5 is an expanded sectional view of a substantial part showing a procedure of assembling the commodity display device according to an embodiment of the invention; FIG. 6 is an expanded sectional view of the substantial part showing the procedure of assembling the commodity display device according to the embodiment of the invention; and FIG. 7 is a perspective view showing another example of the hanging shelf member according to an embodiment of the invention.

FIG. 1 illustrates a structure of the commodity display device according to the invention attached to a wall surface 1 of a shop or the like. The commodity display device according to the invention is comprised of wall surface members 2 and hanging shelf members 3 as shown in the figure.

The wall surface member 2 is formed by forming a catching protrusion bar 2*b*, which overhangs from a long vertical wall surface 2*a*, on the vertical wall surface 2*a* which is attached to the wall surface 1 or the like of a shop or the like, extending the catching protrusion bar 2*b* to form a semicircular flection 2*c* downward so to form a catching groove 2*d* on the inside wall of the flection 2*c* and forming a catching groove 2*e* on the inside wall of the vertical wall surface 2*a* so to form a turning space 2*f*. The hanging shelf member 3 has a catching member 3*a* vertically formed at a leading end of a support member 4 for supporting commodities or the like to be displayed, a leading end of the catching member 3*a* bent into an L shape to form a standing part 3*b*, and engagement projections 3*c*, 3*d* formed on the bent part and the pointed part of the standing part 3*b*.

The wall surface member 2 and the hanging shelf member 3 will be described with reference to FIG. 2 and FIG. 3.

The wall surface member 2 which is attached to the wall surface 1 has the catching protrusion bar 2*b*, which overhangs from the vertical wall surface 2*a*, formed on the long vertical wall surface 2*a* as shown in FIG. 3. The catching protrusion bar 2*b* is integrally formed in plural numbers, for example two or three, on the vertical wall surface 2*a* in a longitudinal direction. The catching protrusion bar 2*b* is extended downward to form the semicircular flection 2*c* so to form the turning space 2*f* having the catching grooves 2*d*, 2*e* on its inside wall. At the bottom of the catching protrusion bar 2*b*, an opening 2*g* for inserting the standing part 3*b* of the hanging shelf member 3 is formed between the vertical wall surface 2*a* and the leading end of the catching protrusion bar 2*b*.

The top end of the wall surface member 2 has a small thickness, and countersunk screw holes 5, which have a two-stage inside diameter and depth, are formed at the top end of the wall surface member 2. A setscrew 6 for fixing the wall surface member 2 to the wall surface 1 or pillars of a shop and the like is inserted through the countersunk screw hole 5 as shown in FIG. 2. The head of the setscrew 6 is buried in the countersunk screw hole 5. As shown in FIG. 3, a catching protrusion bar 2*b* having a circular catching face is horizontally formed in the neck of the uppermost catching projection.

Meanwhile, the lower part of the wall surface member 2, which is positioned above the lower wall surface member 2, is formed to have its back surface scooped (hollowed) so to have a small thickness. And, this lower part is overlaid to cover the thin top end of the wall surface member 2, and a catching projection, which is formed at the bottom end to have a circular catching face, is fitted into the catching groove 7. Thus, the setscrew 6 is not exposed to the surface of the wall surface member 2, and the wall surface member 2 is position above and connected to the top of the wall surface member 2 as shown in FIG. 3.

All the catching protrusion bars 2*b* have the same shape and dimensions to have an overhang form and the opening 2*g* at the bottom, and the turning space 2*f* is formed in a position to oppose the wall surface member 2 and to continue from the opening 2*g*.

Then, the hanging shelf member 3 will be described with reference to FIG. 4. The hanging shelf member 3 has the catching member 3*a* formed vertically at the leading end of the support member 4 for supporting commodities and the like to be displayed, the end of the catching member 3*a* bent into an L shape to form the standing part 3*b*, and the engagement projections 3*c*, 3*d* formed on the bent part and the pointed part of the standing part as shown in FIG. 4. Thus, the engagement projection 3d of the hanging shelf member 3 is formed by protruding from the back surface of the standing part bent in the L shape and having a slope on the side of the catching member 3*a*. The standing part 3*b* which is erected into the L shape at one end has a shape and dimensions so to be insertable into the turning space 2*f* through the opening 2*g*. The leading end of the standing part 3*b* and the base bottom surface of the standing part 3*b* are formed to have the engagement projections 3*c*, 3*d* as the engagement members which can be engaged with the catching grooves 2*d*, 2*e* within the turning space 2*f*. The turning space 2*f* as a whole has a shape with dimensions slightly larger than and similar to the standing part 3*b*.

Therefore, the leading end of the catching member 3*a* including the standing part 3*b* has a shape and dimensions so to be movable with some allowance within the opening 2*g* and the turning space 2*f* of the catching projections bar 2*b*.

The catching member 3*a* can also be formed to have a shelf board 15 as a commodity supporting member protruded into a substantially T shape as shown in FIG. 7.

Then, a method of assembling the commodity display device will be described with reference to FIG. 5, FIG. 6 and FIG. 1.

As shown in FIG. 1, the wall surface member 2 is attached to the bottom of the wall surface 1 of shops, exhibition booths and the like with the setscrews 6, and the next wall surface member 2 is attached to cover the top of the first wall surface member 2. Thus, the wall surface members 2 are sequentially assembled to form the vertical wall surface.

Subsequently, the catching member 3*a* is fitted to the catching protrusion bar 2*b* of the wall surface member 2. As shown in FIG. 5, the end of the standing part 3*b* of the catching member 3*a* is positioned in the opening 2*g* of the catching protrusion bar 2*b* at an angle that the catching member 3*a* becomes substantially horizontal.

Subsequently, the catching member 3*a* is turned to guide the standing part 3*b* in the arrow direction from the opening 2*g* deep into the turning space 2*f* and pivoted in the turning space 2*f* of the catching protrusion bar 2*b* as shown in FIG. 6.

By turning in the arrow direction, the catching member 3*a* changes from the vertical state to a state parallel with the wall surface member 2 as shown in FIG. 6. And, the standing part 3*b* is within the turning space 2*f*, and the bottom surface of the catching member 3*a* (the left side surface in FIG. 6) comes substantially into contact with the wall surface member 2. Therefore, the support member 4 becomes substantially vertical to the wall surface member 2. Here, when the turning operation is ended, the catching member 3*a* lowers slightly by its own weight, and the engagement projections 3*c*, 3*d* are fitted into the catching grooves 2*d*, 2*e*. Therefore, the standing part 3*b* is stably held without dropping out of the turning space 2*f*. Thus, commodities can be placed on, displayed on or hanged from the support member 4, which is vertically protruded with respect to the catching member 3*a*.

The hanging shelf member can also be placed on the support member 4 and held to be horizontal as well as vertical with respect to the wall surface member 2. And, even when the commodities are placed on it, the catching member 3*a* does not come off the catching protrusion bar 2*b*, and the commodities can be safely exhibited or displayed. And, the catching member 3*a* can be removed simply and quickly from the wall surface member 2 by reversing the procedure shown in FIG. 5 and FIG. 6.

The hanging shelf member 3, which is attached to the catching protrusion bar 2*b*, is not detached from the catching protrusion bar 2*b* unless the catching member 3*a* is turned an angle so to become substantially horizontal as shown in FIG. 5. Therefore, even if the hanging shelf member 3 is turned a prescribed angle when commodities are suspended from the support member 4, the hanging shelf member 3 is not detached from the catching protrusion bar 2*b*. Thus, the commodities can be exhibited or displayed efficiently.

The support member described above had a rod shape as an example as shown in FIG. 4, but it is not limited to the rod shape but can be a long plate-shaped support member 15 with a board type catching member 12 as shown in FIG. 7. In this embodiment, the support member 15, which is formed through the catching member 12, can be used as a shelf.

Figure 8:
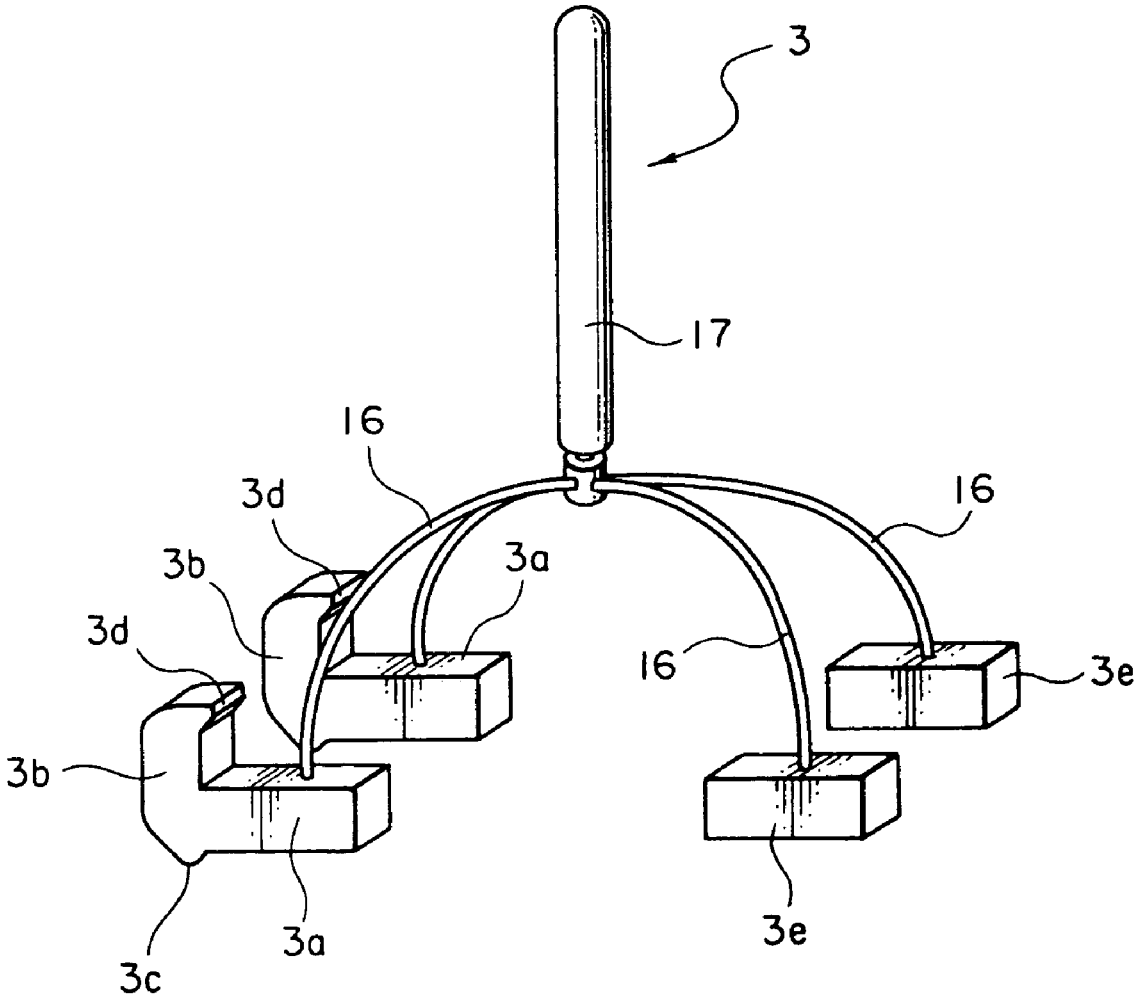
FIG. 8 is a perspective view showing another example of the hanging shelf member according to an embodiment of the invention.

As shown in FIG. 8, the shelf hanging member 3 may be configured by dividing to have catching parts 3*a*, 3*a* and holding parts 3*e*, 3*e*, extending a support rod 16 from each of them and disposing a support member 17 at the center. In this case, the catching parts 3*a*, 3*a* have the standing part which is configured in the same way as in FIG. 4. And, the standing part has the same function and effect.

As described above, according to the present invention, the standing part of the catching member is inserted through the opening and turned so to engage with the catching grooves for the engagement projections so to hang along the flat surface of the catching member with respect to the vertical wall surface of the wall surface member, and the support member can be protruded in a direction orthogonal to the vertical wall. Thus, there is provided an advantage that commodities can be displayed easily and quickly.

Because the engaged state of the turning space and the standing part of the catching member is obtained by the turning operation of the engaged member and its lowering by its own weight, there is obtained an effect that the support member can be attached to and removed from the wall surface member securely, simply and quickly by a single operation.

The vertical wall surface member is formed by assembling plural wall surface members to be vertically adjacent to each other and screwing one of the neighboring wall surface members to cover the setscrews of the other wall surface member, so that the vertical wall can be assembled to have an area according to the space, height and the like of shops. Thus, there are obtained the effects that the setscrews can be prevented from being exposed, and the decorative and interior effects of the entire wall surface can be enhanced.

It is to be understood that the present invention is not limited to the specific embodiments thereof illustrated herein, and various modifications may be made without deviating from the spirit and scope of the invention.

What is claimed is:

1. A commodity display device, comprising:

a wall surface member and a hanging shelf member engaged with the wall surface member;

the wall surface member comprising, an installation part having a vertical surface disposed to be attached to a wall surface;

a catching protrusion bar protruded and overhung from the vertical surface of the installation part, expanded downward to form a semicircular flection with a leading end of the catching protrusion bar up;

a first catching groove formed with the leading end of the catching protrusion bar and an inside;

a second catching groove formed at a height almost equal to the leading end of the catching protrusion bar on the vertical surface of the installation part;

a turning space formed above the leading end of the catching protrusion bar and the first catching groove; and an opening formed between the installation part and the leading end of the catching protrusion bar and having an opened lower side;

the hanging shelf member comprising:

a support member for supporting an exhibited commodity, the support member having at least one end; and a catching member vertically installed on the end of the support member;

the catching member having a standing part formed to bend a leading end of the catching member toward a support member side forming an L shape;

a first engagement projection formed at a leading end of the standing part and projected toward the support member side; and a second engagement projection formed by a protrusion extending from a back surface of the standing part, wherein the first engagement projection is first inserted with turning into the opening of the wall surface member, the first engagement projection engages with the first catching groove, the second engagement projection engages with the second catching groove, and the catching member comes into close contact with the vertical surface of the installation part.

2. The commodity display device according to claim 1, wherein the engagement projections of the hanging shelf member are fitted into the catching grooves in the turning space by a turning operation of the engagement projections and lowering of the hanging shelf member by its own weight.

3. The commodity display device according to claim 1, wherein the installation part comprises plural wall surface members which are assembled to be mutually adjacent in a vertical direction, and one of the adjacent wall surface members is disposed to cover setscrews of the other adjacent wall surface member.

* * * * *